US006370983B1

(12) United States Patent
Nakamura

(10) Patent No.: US 6,370,983 B1
(45) Date of Patent: Apr. 16, 2002

(54) ANGLE DETECTING DEVICE

(75) Inventor: Moritoshi Nakamura, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/688,516

(22) Filed: Oct. 16, 2000

(30) Foreign Application Priority Data

Oct. 18, 1999 (JP) ..... 11-295794

(51) Int. Cl.[7] ..... G05G 1/14
(52) U.S. Cl. ..... 74/514
(58) Field of Search ..... 74/514, 513, 512; 248/292.1, 292.14, 299.1; 411/154, 544; 16/438, 900

(56) References Cited

U.S. PATENT DOCUMENTS 5,133,321 A 7/1992 Hering et al.
5,408,899 A * 4/1995 Stewart ..... 74/513
5,416,295 A * 5/1995 White et al. ..... 200/86.5
5,529,296 A * 6/1996 Kato et al. ..... 267/155
5,768,946 A * 6/1998 Fromer et al. ..... 74/514
5,823,064 A * 10/1998 Cicotte ..... 74/512
5,887,488 A 3/1999 Riggle
5,934,152 A * 8/1999 Aschoff et al. ..... 74/513
6,158,299 A * 12/2000 Czajkowski ..... 74/513
6,220,222 B1 * 4/2001 Kalsi ..... 123/399
6,263,758 B1 * 7/2001 Kumamoto et al. ..... 74/513
6,289,762 B1 * 9/2001 Silva ..... 74/513

FOREIGN PATENT DOCUMENTS

JP 920154 * 1/1997 ..... B60K/26/04

* cited by examiner

*Primary Examiner*—David A. Bucci
*Assistant Examiner*—Vicky A. Johnson
(74) *Attorney, Agent, or Firm*—Brinks Hofer Gilson & Lione

(57) ABSTRACT

Disclosed is an angle detecting device which comprises a shaft fixedly attached on a frame; a detecting lever to be detected which is rotatably mounted on the shaft; an angle sensor having a rotating portion to be actuated to turn in engagement with the lever to be detected, for detection of rotation angle of the lever to be detected; a bracket mounted with the angle sensor and rotatably installed on the shaft; and screws capable of changing the mounting position of the bracket in relation to the shaft supporting the bracket.

5 Claims, 3 Drawing Sheets

ANGLE DETECTING DEVICE

BACKGROUND OF THE INVENTION

1. Field of the Invention

This invention relates to an angle detecting device and, more particularly, to an angle detecting device suitable for detecting the rotation angle of pedal arms such as an automotive brake pedal or an accelerator pedal.

2. Description of the Related Art

Motor vehicles in these days are equipped with a mechanism capable of constantly detecting the rotation angle of pedal arms such as brake and accelerator pedals, thereby enabling fine control of the braking system and accelerator on the basis of data obtained from the detection. For example, detecting the depth of depression of the brake pedal arm by an angle sensor makes it possible to compute the change with respect to time and accordingly to determine whether or not the driver has made an emergency stop. Therefore, a brake assist mechanism can be adopted in which brake performance during an emergency stop is higher than that during a normal stop.

As an angle detecting device for detecting the rotation angle of the pedal arm as described above, there has been proposed such a technique that unitizes a pedal arm, a shaft for rotatably supporting the pedal arm, an angle sensor which engages with the pedal arm to detect the rotation angle of the pedal arm, and a cabinet supporting each of these members by accurately specifying their relative positions. The angle sensor is provided with a rotating portion (a sensor lever) which is actuated to turn in engagement with the pedal arm, so that, with the rotation of the pedal arm when the pedal is depressed, the rotating portion of the angle sensor will turn in accordance with the depth of depression of the pedal.

The angle detecting device thus assembled as a unit has a high degree of accuracy. However, because existing shaft and pedal arm are unusable, an increased manufacturing cost and accordingly an uneconomical angle detecting device will result.

Therefore, it has been proposed to use an angle detecting device that is comprised of a shaft fixed on a frame which is a part of an equipment body on the motor vehicle, a pedal arm rotatably attached on the shaft, and an angle sensor which is mounted on the frame to detect the rotation angle of the pedal arm. The prior art proposed above will be sufficient if only an angle sensor is employed, using the existing shaft and pedal arm. Therefore, it is very advantageous in the respect of manufacturing cost. Besides, a high detecting accuracy is obtainable if only the relative positional relation of the angle sensor and pedal arm is properly set.

The above-described latter prior art is very advantageous in cost. It, however, is unavoidable for the frame, constituting a part of a large-sized equipment body, to have a dimensional error of a few millimeters. Accordingly it is difficult to install the angle sensor in a desired position on the frame in relation to the shaft and the pedal arm. That is, to insure an accurate detection of the rotation angle of the pedal arm, it becomes imperative to set at a specific value a clearance between the shaft at the center of rotation of the pedal arm and the center of rotation of the rotating portion of the angle sensor, and also to arrange the rotating portion of the angle sensor in a specific position when the rotation angle of the pedal is in an initial zero position. In the prior art, however, position adjustment for setting the angle sensor in a given position in relation to the shaft and the pedal arm is likely to become complicated because of large variations in dimensions of the frame, which serves as the angle sensor mounting surface. Therefore, in case the frame has an excessive dimensional error, it is impossible to obtain a desired detection accuracy notwithstanding the position adjustment of the angle sensor.

SUMMARY OF THE INVENTION

It is, therefore, an object of this invention to provide an angle detecting device in which the lever of a pedal arm to be detected is rotatably installed on a shaft which is fixed on a frame; and a bracket for mounting an angle sensor is rotatably installed on the shaft, to thereby enable adjustment of angle sensor position by adjusting bracket position. According to this configuration, a clearance between the angle sensor mounted on the bracket and the shaft can be preset with a high accuracy. In addition, the rotating portion of the angle sensor can be arranged in a desired initial position by adjusting the mounting position of the bracket in relation to the shaft. Consequently, the position of the angle sensor is readily adjustable at the time of mounting, and the rotational angle of the lever to be detected can be detected with high accuracy. In the angle detecting device, therefore, an existing shaft and a detecting lever to be detected are usable, making it unnecessary to unitize the angle detecting device; that is, only installing the angle sensor and the bracket is sufficient, resulting in an advantageous cost.

The angle detecting device of this invention comprises a shaft fixed on a frame, a lever to be detected which is rotatably mounted on the shaft, an angle sensor having a rotating portion which is operated to turn in engagement with the lever to be detected and capable of detecting the rotation angle of the lever to be detected, a bracket mounted with the angle sensor and rotatably attached on the shaft, and an adjusting member capable of changing the mounting position of the bracket in relation to the shaft. The bracket set in a specific mounting position by the adjusting member is fixedly attached to the frame.

In the angle detecting device thus constituted, the bracket mounted with the angle sensor is rotatably attached on the shaft. Therefore there can be specified a clearance with a high accuracy between the angle sensor and the shaft. Furthermore, it is possible to move the center of rotation of the rotating portion of the angle sensor along the direction of rotation while keeping the clearance by adjusting the mounting position of the bracket in relation to the shaft, and to easily adjust the rotating portion of the angle sensor to a desired initial position, and accordingly to accurately detect the rotation angle of the lever to be detected, by means of the angle sensor.

Other objects, together with the foregoing, are attained in the embodiments described in the following description and illustrated in the accompanying drawings.

DESCRIPTION OF THE PREFERRED EMBODIMENTS

Figure 1:
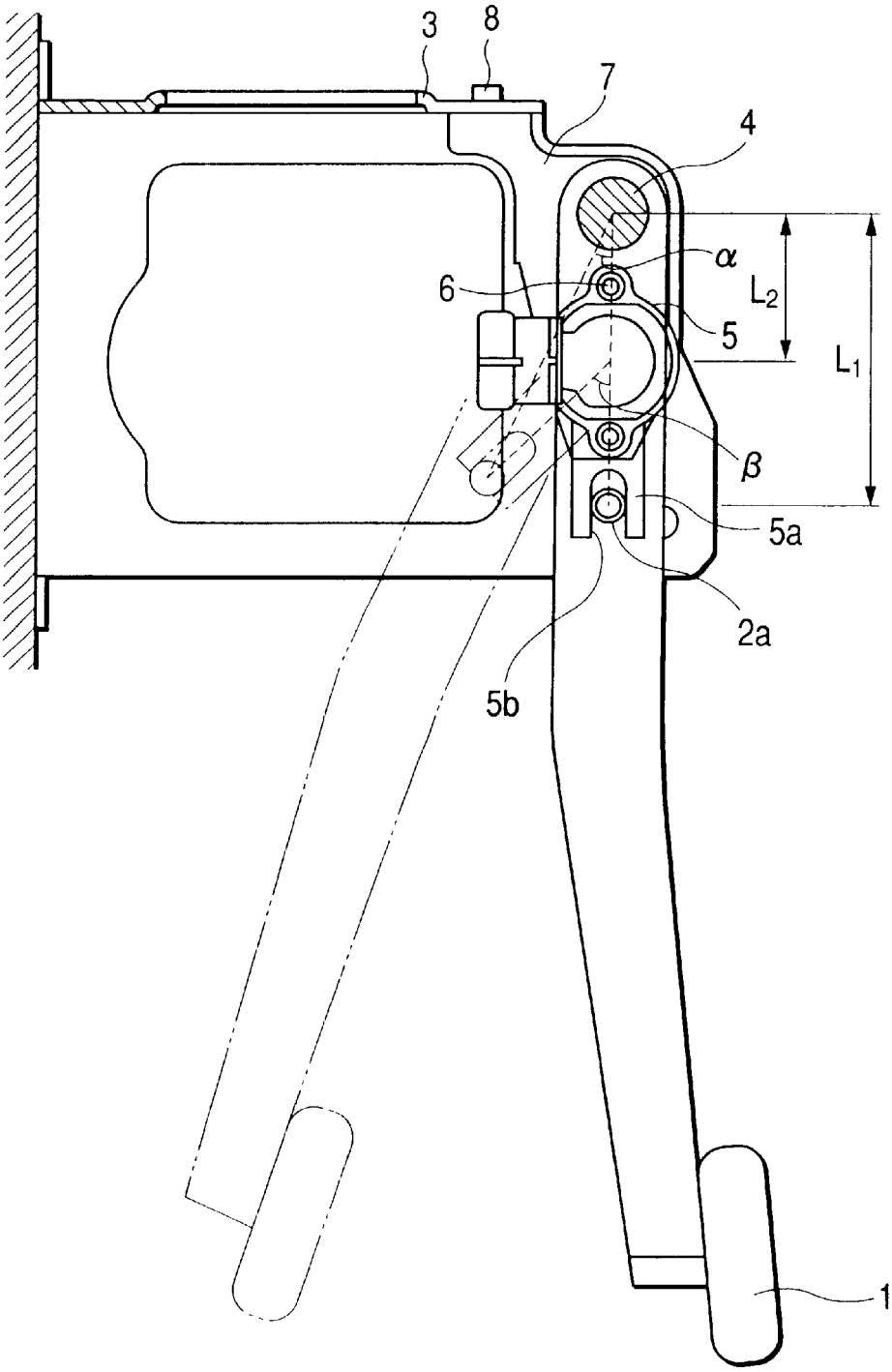
FIG. 1 is a side view of one embodiment of angle detecting device according to this invention.
Figure 2:
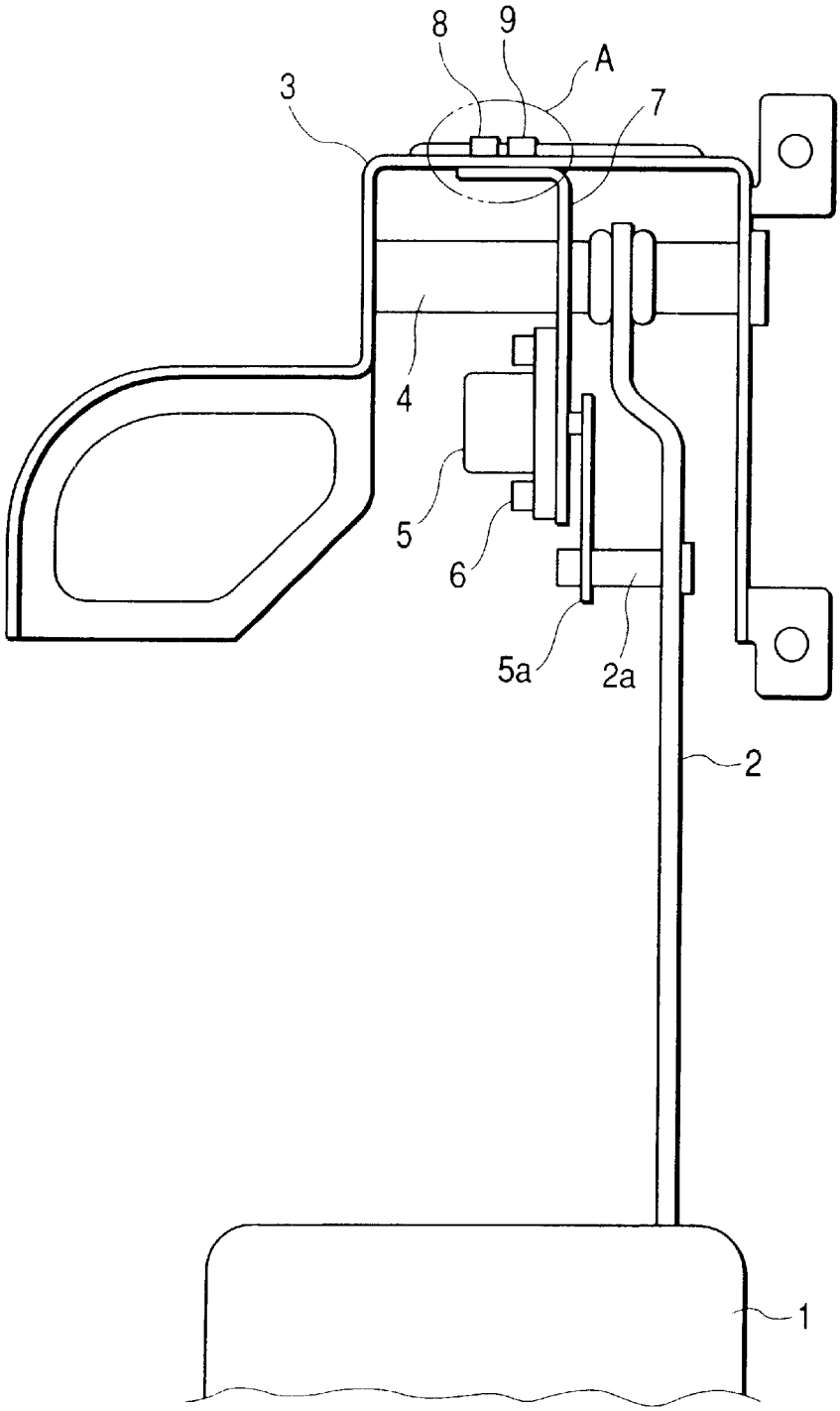
FIG. 2 is a front view of the angle detecting device.
Figure 3:
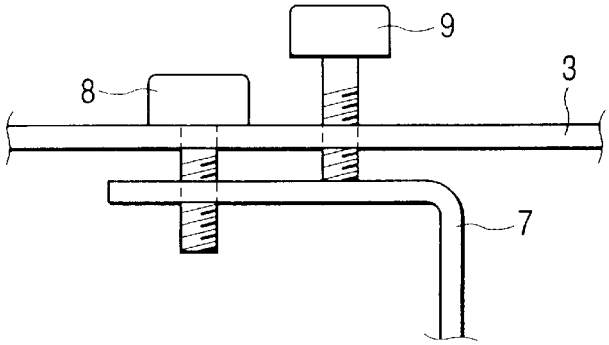
FIG. 3 is an explanatory view with the A part of FIG. 2 enlarged.

Preferred embodiments of an angle detecting device according to this invention will be described with reference to the accompanying drawings. FIG. 1 is a side view showing one embodiment of the angle detecting device according to this invention; FIG. 2 is a front view of the angle detecting device; and FIG. 3 is an explanatory view with the A part in FIG. 2 enlarged.

The angle detecting device shown in FIGS. 1 and 2 functions to detect the depth of depression of a vehicle brake pedal 1. The angle detecting device comprises a pedal arm 2 with a brake pedal 1 attached on the forward end thereof, a shaft 4 which is fixed on a frame 3 forming a part of the equipment body on the motor vehicle and on which the base end portion of the pedal arm 2 is rotatably mounted, an angle sensor 5 such as a variable resistor having a forked sensor lever (rotating portion) 5*a* which is actuated to turn in engagement with a driving pin 2*a* of the pedal arm 2 and having a B-curve output characteristic capable of detecting the rotation angle of the pedal arm 2, a bracket 7 rotatably installed through on a shaft 4 and mounted with the angle sensor 5 by fastening by a screw 6, a connecting-adjusting screw 8 installed at the upper end portion of the bracket 7 to fixedly attach the bracket 7 to the frame 3, and a pressure screw 9 which is screwed into the frame 3 and in contact with the upper end surface of the bracket 7.

The driving pin 2*a* of the pedal arm 2 is inserted in a cutout 5*b* of the sensor lever 5*a*. With the rotation of the pedal arm 2, the driving pin 2*a* turns the sensor lever 5*a* while sliding in the cutout 5*b*. As shown in FIG. 3, when the connecting adjusting screw 8 is turned out and the pressure screw 9 is turned in, the upper end portion of the bracket 7 is pushed down, allowing the bracket to slightly turn counterclockwise in FIG. 1 on the center of the shaft 4. Reversely, when the connecting-adjusting screw 8 is turned in and the pressure screw 9 is turned out, the upper end portion of the bracket 7 is raised, allowing the shaft 4 to turn the bracket 7 slightly clockwise in FIG. 1 on the center of the shaft 4.

In the angle detecting device thus constituted, when the driver depresses the brake pedal 1, the pedal arm 2 turns through the angle $\alpha$ for example as shown in FIG. 1, moving from the initial position indicated by a full line in FIG. 1 to a position indicated by a chain line. At this time, the driving pin 2*a* installed integrally with the pedal arm 2 also turns through the angle $\alpha$ on the center of the shaft 4. Therefore, the sensor lever 5*a* of the angle sensor 5 is driven by the driving pin 2*a*, turning through the angle $\beta$ as indicated in FIG. 1. However, since the distance to the center of rotation of the sensor lever 5*a* is shorter than the distance L1 to the axial center of the shaft 4, the angle $\alpha$ is greater than the angle $\beta$ for the driving pin 2*a*. That is, since the sensor lever 5*a* turns through a large angle correspondingly to the rotation angle of the pedal arm 2. Therefore, the angle sensor 5 is designed to detect the rotation angle of the pedal arm 2 with a high resolution on the basis of the rotation angle of the sensor lever 5*a*. Rotation angle detected by the angle sensor 5 is evaluated as a variation in output voltage; that is, the rotation angle is calculated from the output voltage. For the angle sensor 5, therefore, it is necessary to set the output voltage to a specific value when the sensor lever 5*a* is in the initial position indicated by a full line.

Since the bracket 7 with the angle sensor 5 is rotatably mounted on the shaft 4, the angle detecting device stated above can preset with high accuracy the clearance L2 between the center of rotation of the sensor lever 5*a* and the axial center of the shaft 4, and keep an accurately preset L1/L2 value which is important for computing the rotation angle of the pedal arm from the rotation angle of the sensor lever 5*a*. Therefore, it is possible to obtain a specific output at a desired rotation angle of the sensor lever 5*a* of the angle sensor 5 if the angle detecting device is so adjusted at the time of installation as to obtain the specific output, and furthermore to easily improve detection accuracy at an arbitrary rotation angle of the pedal arm 2. Furthermore, the angle detecting device is of such a design that since the mounting position of the bracket 7 in relation to the shaft 4 can be adjusted by turning in and out the connecting-adjusting screw 8 and the pressure screw 9, the center of rotation of the sensor lever 5*a* can be moved along the direction of rotation while keeping the clearance L2. Therefore, in case the output voltage of the angle sensor 5 can not be set at a specific value, because of an effect of frame 3 deviation from position, when the sensor lever 5*a* is in the initial position, the initial position of the sensor lever 5 can easily be adjusted by adjusting the mounting position of the bracket 7. From this point also, it is possible to improve detection accuracy with ease. In the angle detecting device, the existing shaft 4 and the pedal arm 2 are usable and therefore it is unnecessary to unitize the angle detecting device. Just mounting the angle sensor 5, bracket 7, and screws 8 and 9 is sufficient; the angle detecting device, therefore, is advantageous in cost. When the pedal arm 2 is turned after the initial position adjustment, the voltage is outputted along a specific output characteristic; and high-accuracy measurement of the rotation angle of the pedal arm 2 can be made by measuring the voltage.

In the present embodiment, the detection of the rotation angle of the pedal arm 2 of the brake pedal 1 has been described as an example. It, however, should be noticed that the rotation angle of the accelerator pedal arm and rotating levers of other operating bodies than the pedal can be detected with a high accuracy by the use of a similar mechanism.

Figure 4:
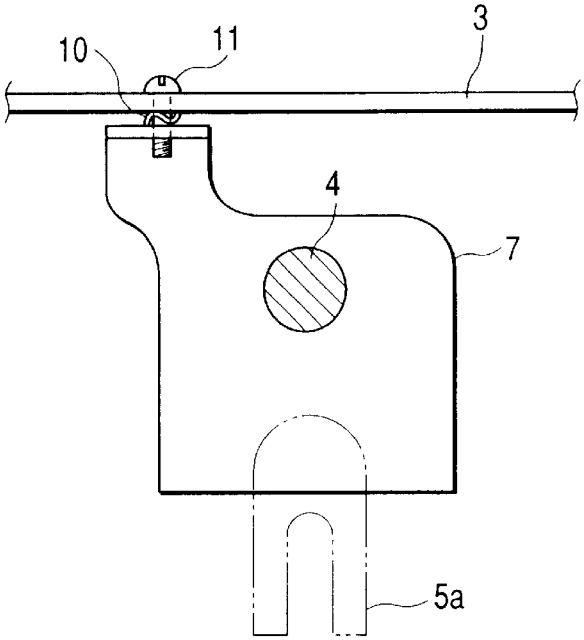
FIG. 4 is a side view showing the mounting structure of a bracket pertaining to another embodiment of this invention.

It is also to be noted that, in the above-described embodiment, the two screws 8 and 9 are used to adjust the mounting position of the bracket 7; as shown in FIG. 4, however, a single connecting-adjusting screw 11 screwed in the frame 3 and the bracket 7 which are oppositely arranged through a waved washer 10 may be used, so that the mounting position of the bracket 7 can be adjusted by turning in or out the screw 11.

Figure 5:
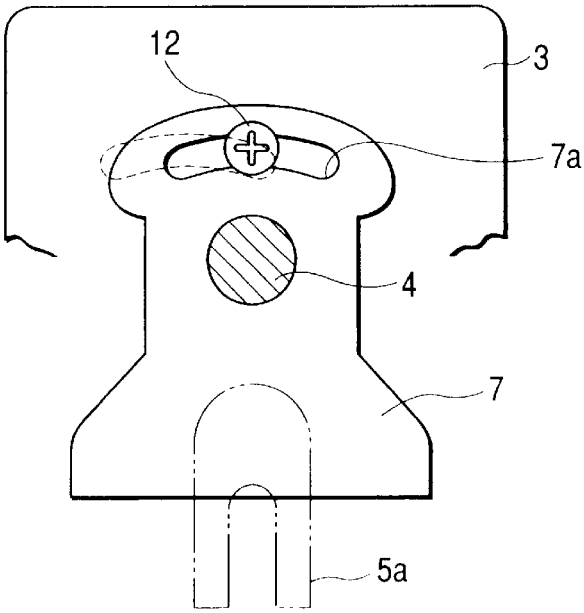
FIG. 5 is a side view showing the mounting structure of further another embodiment of this invention.

Furthermore, the angle detecting device may be of such a constitution that, as shown in FIG. 5, a long hole 7*a* is formed extending along the direction of rotation of the bracket 7, so that the bracket 7 is secured to the frame 3 by a fixing screw 12 inserted in the long hole 7*a*. In this case, it is advised that the mounting position of the bracket 7 in relation to the shaft 4 be adjusted, with the fixing screw 12 loosened, and the fixing screw 12 be tightened after completion of the adjustment.

This invention executed in the embodiments heretofore described has the following advantages.

It is possible to preset the clearance between the angle sensor and shaft mounted on the bracket with a high accuracy, and also to arrange the rotating portion of the angle sensor in a desired initial position by adjusting the mounting position of the bracket with respect to the shaft position. Therefore, it is possible to provide the angle detecting device that the position adjustments can readily be accomplished at the time of installation, and that the rotation angle of the lever such as the pedal arm to be detected can be detected with a high accuracy. In the angle detecting device, the existing shaft and the lever to be detected are usable and therefore it is unnecessary to unitize the angle detecting device. Provision of the angle sensor and the bracket is sufficient, resulting in advantageous costs.

What is claimed is:

1. An angle detecting device, comprising: a shaft fixedly attached on a frame; a detecting lever to be detected which is rotatably mounted on the shaft; an angle sensor having a rotating portion to be actuated to turn in engagement with the lever be detected, said angle sensor for detection of a rotation angle of the lever to be detected; a bracket retaining the angle sensor and rotatably mounted on the shaft; and an adjusting member capable of changing the mounting position of the bracket in relation to the shaft; the bracket set in a specific mounting position by the adjusting member being fixedly attached on the frame.

2. An angle detecting device as claimed in claim 1, wherein there are provided a pressure screw threadedly installed in the frame in contact with the bracket and a connecting-adjusting screw threadedly installed in the bracket and locked with the frame, said mounting position of the bracket being adjusted by turning the pressure screw and the connecting-adjusting screw.

3. An angle detecting device as claim in claim 1, wherein a connecting-adjusting screw is threadedly installed in the frame and the bracket which are arranged in opposite positions through a washer, said mounting position of the bracket being adjusted by turning the connecting-adjusting screw.

4. An angle detecting device as claimed in claim 1, wherein a long hole is provided in the bracket, extending along the direction of rotation; and also provided is a fixing screw inserted in the long hole, fixing the bracket to the frame.

5. An angle detecting device as claimed in claim 1, wherein the lever to be detected is a pedal arm with a foot-operated pedal attached on a forward end portion thereof.

* * * * *